United States Patent [19]

Budzich

[11] Patent Number: 5,044,256

[45] Date of Patent: Sep. 3, 1991

[54] EXHAUST PRESSURIZING CONTROL FOR A FLUID SYSTEM

[75] Inventor: Tadeusz Budzich, Moreland Hills, Ohio

[73] Assignee: Caterpillar Inc., Peoria, Ill.

[21] Appl. No.: 609,348

[22] Filed: Nov. 5, 1990

[51] Int. Cl.[5] ..... F15B 13/08

[52] U.S. Cl. ..... 91/529; 91/436; 91/530; 137/596.14; 137/596.1; 137/596.2

[58] Field of Search ..... 91/436, 527, 529, 530; 137/596.13, 596.14, 596.1, 596.2

[56] References Cited

U.S. PATENT DOCUMENTS

| | | | |
|---|---|---|---|
| 3,472,127 | 10/1969 | Scheidt | 91/437 |
| 4,099,379 | 7/1978 | Budzich | 60/427 |
| 4,222,409 | 9/1980 | Budzich | 137/596 |
| 4,249,570 | 2/1981 | Budzich | 137/596.13 |
| 4,267,860 | 5/1981 | Budzich | 137/596.2 |
| 4,325,408 | 4/1982 | Budzich | 137/596.2 |

*Primary Examiner*—Gerald A. Michalsky
*Attorney, Agent, or Firm*—J. W. Burrows

[57] ABSTRACT

Fluid systems having fluid motors which control aiding type loads many times have problems with cavitation in one end of the fluid type motor during lowering thereof. It is desirable to eliminate all cavitation in the fluid motor during operation. In order to eliminate cavitation during lowering of an aiding type load and to provide a positive pressure therein, the subject arrangement provides an exhaust pressurizing control for use in a fluid system. The exhaust pressurizing control includes an exhaust manifold means having selector means to provide a positive pressure in the exhaust manifold means during lowering of an aiding type load. The selector means includes pressure limiting and unloading means operative to provide a positive pressure in the exhaust manifold means during lowering of the aiding type load and to unload the pressurized fluid in the exhaust manifold means during raising of a resisting type load. The pressurized fluid in the exhaust manifold means is available to the fluid motor through anti-cavitational valve means. This arrangement effectively eliminates cavitation in the fluid motor.

27 Claims, 4 Drawing Sheets

SIGNAL GENERATOR
SIGNAL GENERATOR

SIGNAL GENERATOR
SIGNAL GENERATOR 10
109
112
28
30
20'
111
16
24
W1
W2
25
82
23
110
114
42
32
113
34
18
136
22'
134
24
26
23
86
44
68'
64'
14
25
36
SIGNAL GENERATOR
138
54'
38
140
46
76'
72'
132
12
SIGNAL GENERATOR
ELECTRICAL SOURCE
130
14
56'
150
152
82
98'
88
96
90
148
80
82
144
84
146
94
82
92
84
14
184
14
82

EXHAUST PRESSURIZING CONTROL FOR A FLUID SYSTEM

DESCRIPTION

1. Technical Field

This invention relates generally to a hydraulic fluid system and more particularly to an exhaust pressurizing control for a fluid system.

2. Background Art

Fluid systems normally have control valves that selectively direct pressurized fluid to a fluid motor and the exhaust fluid from the fluid motor is directed across the control valve back to a reservoir. In applications where the rate of lowering a load is so fast that sufficient fluid is not available to fill the other end of the cylinder, cavitation results in the other end of the cylinder. Cavitation being defined as the absence of a positive pressure and the presence of a vacuum or a negative pressure. In order to offset this problem, conventional make-up valves have been added to the cylinder lines to allow fluid from the reservoir to fill the cavitated end of the cylinder. Such an arrangement is set forth in U.S. Pat. No. 3,472,127 issued Oct. 14, 1969 to J. P. Scheidt. Even though this arrangement helps to offset the problem of cavitation in the cylinder, it does not alleviate the problem. U.S. Pat. No. 4,099,379 issued July 11, 1978 to Tadeusz Budzich, teaches an arrangement wherein a pressure relief valve is located in the fluid flow return line to the reservoir. The relief valve ensures that a positive pressure is always provided in the return line, consequently, pressurized fluid is always available to the other end of the cylinder at all times. In this arrangement, the cylinder is never allowed to cavitate during lowering of a load since the positive pressure in the return line is always available to the cylinder through the make-up valves or conversely, through the inlet of the control valve. In the arrangement as set forth in FIG. 3 of the noted patent, the return line is pressurized even if there is no tendency for the cylinder to cavitate. Consequently, extra energy is being used to force the fluid flow returning to the reservoir to flow across the relief valve which is detrimental to the overall efficiency of the system.

Various arrangements have been set forth in the past wherein an unloading valve or a variable relief valve have been utilized in the return line. In these arrangements, the unloading valve or variable relief valve has been operative in response to the presence of a negative load condition. The major disadvantage in these arrangements is the requirement of having some form of a negative load sensing circuit to sense and provide a positive pressure representative of the negative load to activate the unloading valve or variable relief valve. These arrangements are set forth in U.S. Pat. No. 4,222,409 issued Sept. 16, 1980 to Tadeusz Budzich, U.S. Pat. No. 4,249,570 issued Feb. 10, 1981 to Tadeusz Budzich, and U.S. Pat. No. 4,325,408 issued Apr. 20, 1982 to Tadeusz Budzich.

As used herein, the term "unidirectional positive type load" means a load opposing movement of the cylinder in a given direction and "unidirectional negative type load" means a load aiding movement of the cylinder in a given direction. The term "positive load signal" means a signal representative of the magnitude of the unidirectional positive type load and the term "negative load signal" means a signal representative of the magnitude of the unidirectional negative type load.

The present invention is directed to overcoming one or more of the problems as set forth above.

DISCLOSURE OF THE INVENTION

In one aspect of the present invention, an exhaust pressurizing control is provided and adapted for use in a fluid system. The fluid system has a fluid motor subjected alternatively to a unidirectional positive type load and a unidirectional negative type load. The fluid system further has a pump, a reservoir, and a directional control valve operable to selectively interconnect the fluid motor with the pump and the reservoir. The exhaust pressurizing control includes an exhaust manifold means interposed between the directional control valve and the reservoir. Anti-cavitational valves means is provided in the exhaust pressurizing control and interposed between the exhaust manifold means and the fluid motor. Means for generating a first control signal is provided to control through the directional control valve the movement of the unidirectional type load and for generating a second control signal to control through the directional control valve the movement of the unidirectional negative type load. The exhaust manifold means includes selector means for pressurizing the exhaust manifold means during control of the unidirectional negative type load and to depressurize the exhaust manifold means during control of the unidirectional positive type load. The selector means is responsive to one of the first and second control signals.

The present invention provides an exhaust pressurizing control for use in a fluid system and has a selector valve means for selectively pressurizing the exhaust line when controlling a unidirectional negative type load and depressurizing the exhaust line when controlling a unidirectional positive type load. The subject system does not require special valving to sense the negative load pressure. Consequently, cavitation in the fluid motor that normally occurs when unidirectional negative type loads are experienced is eliminated while also being able to depressurize the exhaust line when operating unidirectional positive type loads.

BEST MODE FOR CARRYING OUT THE INVENTION

Figure 1:
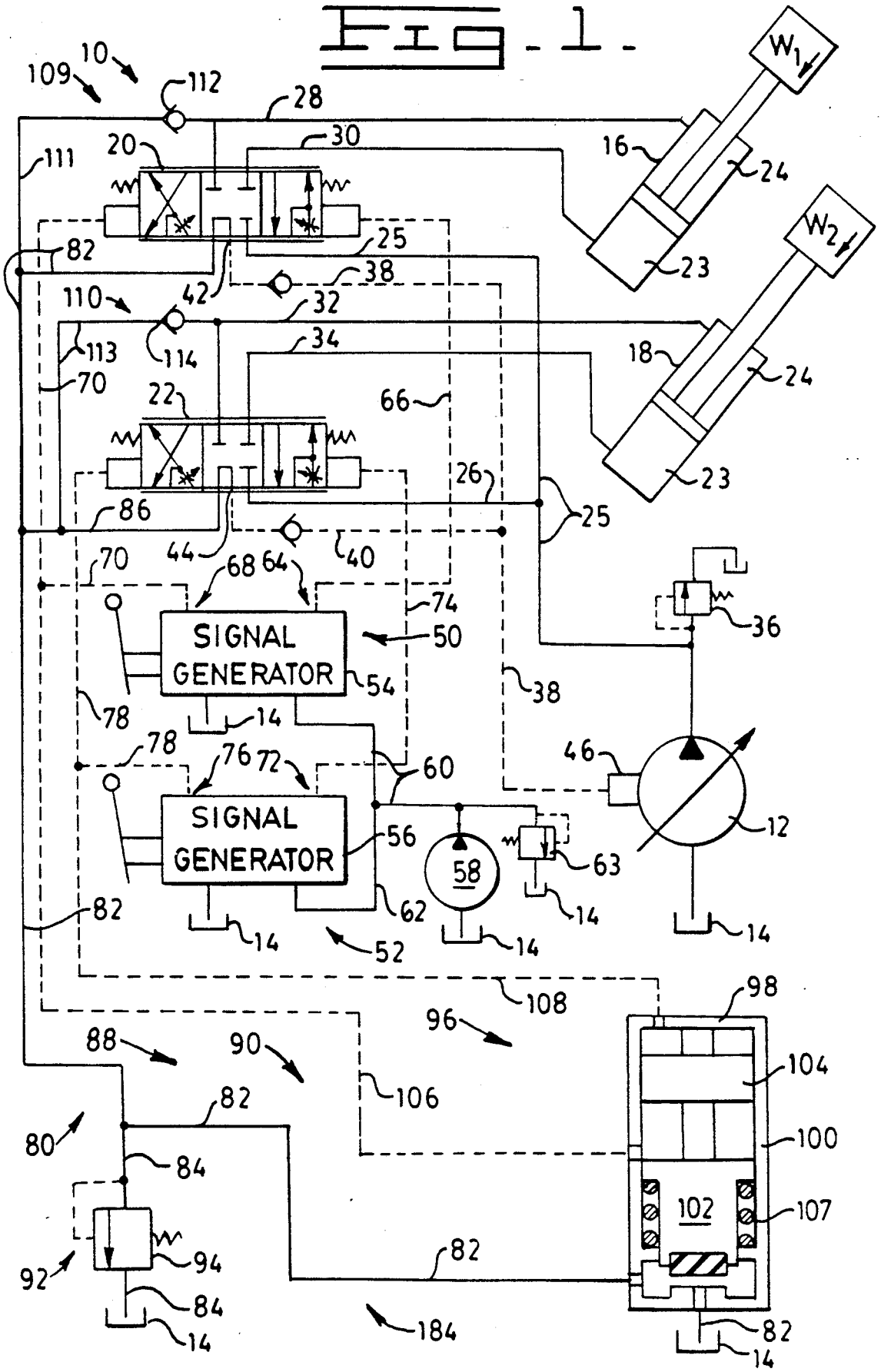
FIG. 1 is a partial schematic and partial diagrammatic representation of a fluid system incorporating an embodiment of the present invention.

Referring now to the drawings, and more particularly to FIG. 1, a fluid system 10 is shown. The fluid system 10 includes a source of pressurized fluid, such as a pump 12, adapted to receive fluid from a reservoir 14, first and second fluid motors, such as hydraulic motors 16,18, and first and second directional control valves 20,22 interposed between the pump 12 and the respective first and second hydraulic cylinders 16,18, and the reservoir 14. Each hydraulic cylinder 16,18 has a head end 23 and a rod end 24. Conduits 25,26 connect the pump 12 with the respective first and second directional control valves 20,22. Conduits 28,30 connect the first directional control valve 20 to the respective rod end 24 and head end 23 of the first hydraulic cylinder 16. Conduits 32,34 connect the second directional control valve 22 with the respective rod end 24 and head end 23 of the second hydraulic cylinder 18. A conventional relief valve 36 is connected to the conduit 25 and operative to control the maximum pressure level in the fluid system 10.

The pump 12 of the subject arrangement, as illustrated, is a variable displacement load responsive pump that is responsive to a load signal for providing the necessary pressurized fluid to the fluid system 10. It is recognized that other types of pumps, such as, fixed displacement or pressure compensated pumps, could be used herein without departing from the essence of the invention. Likewise, each of the first and second directional control valves 20,22 are infinitely variable, hydraulically actuated load responsive control valves. Signal conduits 38,40 respectively connect fluid load signal ports 42,44 of the first and second directional control valves 20,22 to a pump compensator 46 of the pump 12. It is likewise recognized that each of the first and second directional control valves 20,22 could be of a type different from that noted above without departing from the essence of the invention.

First and second generating means 50,52, such as signal generators 54,56, are provided and operative to provide control signals to operate the respective first and second directional control valves 20,22. The first and second signal generators 54,56, of the subject embodiment are hydraulic signal generators and are adapted to receive pressurized fluid from a source of pressurized fluid, such as pump 58, by respective conduits 60,62. A conventional pilot relief valve 63 is connected to the conduit 60 and operative to control the maximum pressure level of the fluid therein.

The first signal generator 54 transmits a first control signal 64 through a conduit 66 to one end of the first directional control valve 22. A second control signal 68 generated by the first signal generator 54 is transmitted through a conduit 70 to the other end of the first directional control valve 22.

The second signal generator 56 transmits a third control signal 72 through a conduit 74 to one end of the second directional control valve 22. A fourth control signal 76 generated by the second signal generator 56 is transmitted through a conduit 78 to the other end of the second directional control valve 22.

Exhaust manifold means 80 is provided in the fluid system 10 between the first and second directional control valve 20,22 and the reservoir 14. The exhaust manifold means 80 includes respective exhaust conduits 82,84,86 which connects the outlet flow from each of the first and second directional control valve 20,22 to the reservoir 14. The exhaust manifold means 80 also includes selector means 88 located in the exhaust conduits 82,84 for selectively pressurizing the exhaust manifold means 80 during control of the respective first and second hydraulic cylinders 16,18.

The selector means 88 includes pressure limiting and unloading means 90 for controlling the maximum pressure therein and for selectively unloading or bypassing the fluid flow to the reservoir 14. The pressure limiting and unloading means 90 includes pressure limiting means 92, such as a pressure relief valve 94 and control means 96.

The control means 96 includes a normally-open unloading valve 98 operative in response to receipt of the second or fourth control signal to selectively interrupt the communication of fluid flow between the exhaust manifold means 80 and the reservoir 14. The normally-open unloading valve 98 includes a housing 100 having a first piston 102 and a second piston 104 slidably disposed therein. The normally-open unloading valve 98 is located in the exhaust conduit 82 and is operative to selectively interrupt flow therein. The first piston 102 is operative to interrupt the fluid flow in exhaust conduit 82 in response to receipt of the second control signal 68 through a conduit 106, and is spring biased to an open position in response to the force of a spring 107. The second piston 104 is located adjacent the first piston 102 and is operative in response to receipt of the fourth control signal 76 through a conduit 108 to move the first piston 102 to the position to interrupt the flow of fluid in the exhaust conduit 82 and is spring biased to the open position in response to the force of spring 107.

A first anti-cavitational valve means 109 interconnects the outlet of the first directional control valve 20 and the rod end 24 of the first hydraulic cylinder 16. A second anti-cavitational valve means 110 interconnects the outlet of the second directional control valve means 22 and the rod end 24 of the second hydraulic cylinder 18. The first anti-cavitational valve means 109 includes a conduit 111 having a check valve 112 disposed therein and connected between the exhaust conduit 82 and the conduit 28. The second anti-cavitational valve means 110 includes a conduit 113 having a check valve 114 located therein and connected between the exhaust conduit 86 and the conduit 32.

Figure 1A:
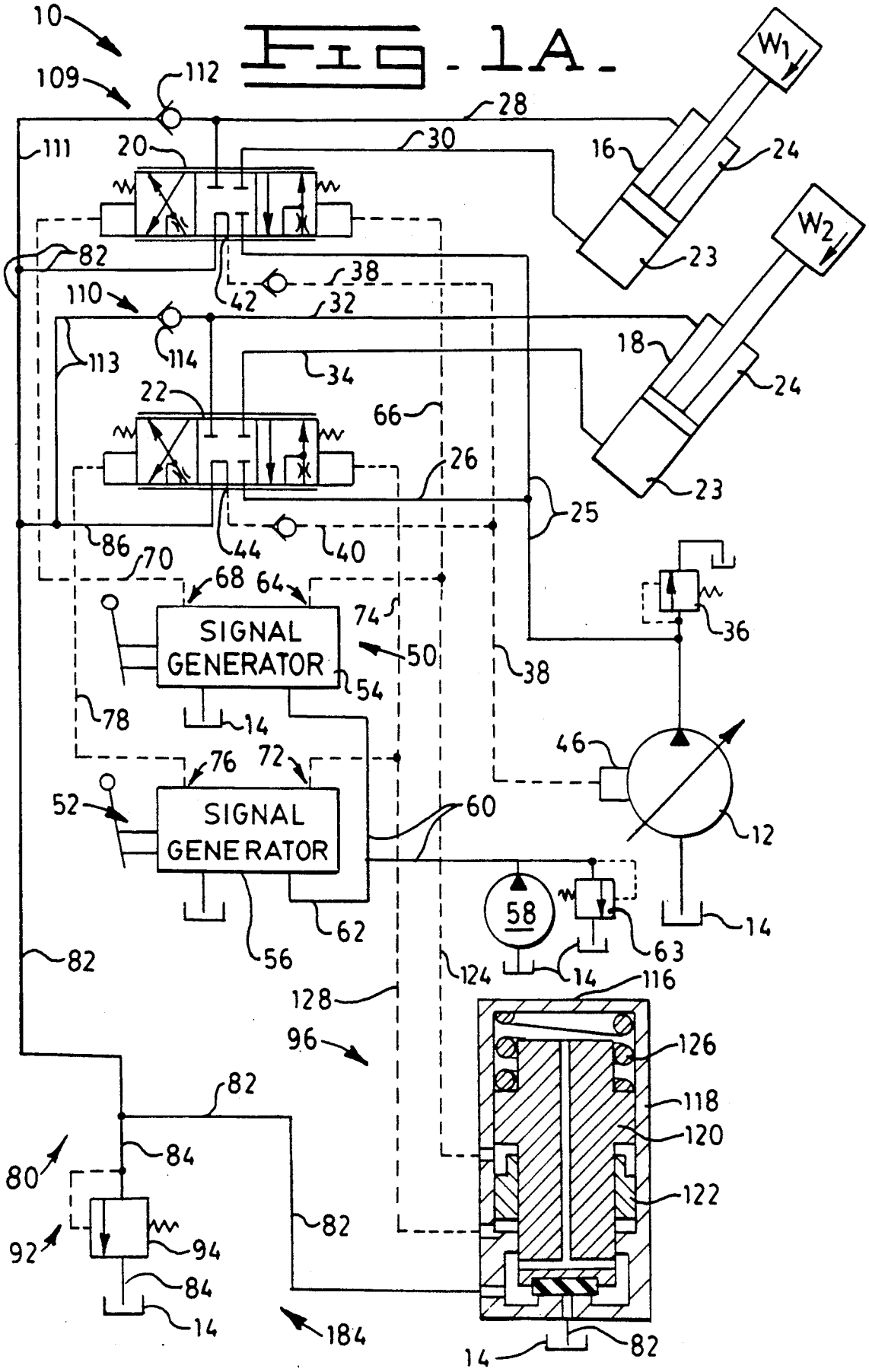
FIG. 1A is a partial schematic and partial diagrammatic representation of a fluid system incorporating an alternate embodiment of the present invention.

Referring now to FIG. 1A, the fluid system 10 is quite similar to the fluid system set forth in FIG. 1. Like components will have like element numbers, while new components will have new element numbers. The control means 96 of FIG. 1A includes a normally-closed unloading valve 116 operative in response to receipt of the first control signal 64 to selectively open communication of fluid flow between the exhaust means 80 and the reservoir 14. The normally-closed unloading valve 116 includes a housing 118 having a first piston 120 and a second piston 122 slidably disposed in the housing 118. The first piston 120 is operative in response to receipt of the first control signal 64 through a conduit 124 to allow the flow of fluid in the exhaust conduit 82 to flow therethrough. The first piston 120 is movable to the closed position by the bias of a spring 126. The second piston 122 is located adjacent the first piston 120 and operative in response to receipt of the third control signal 72 through a conduit 128 to move the first piston 120 to an open position.

Figure 2:
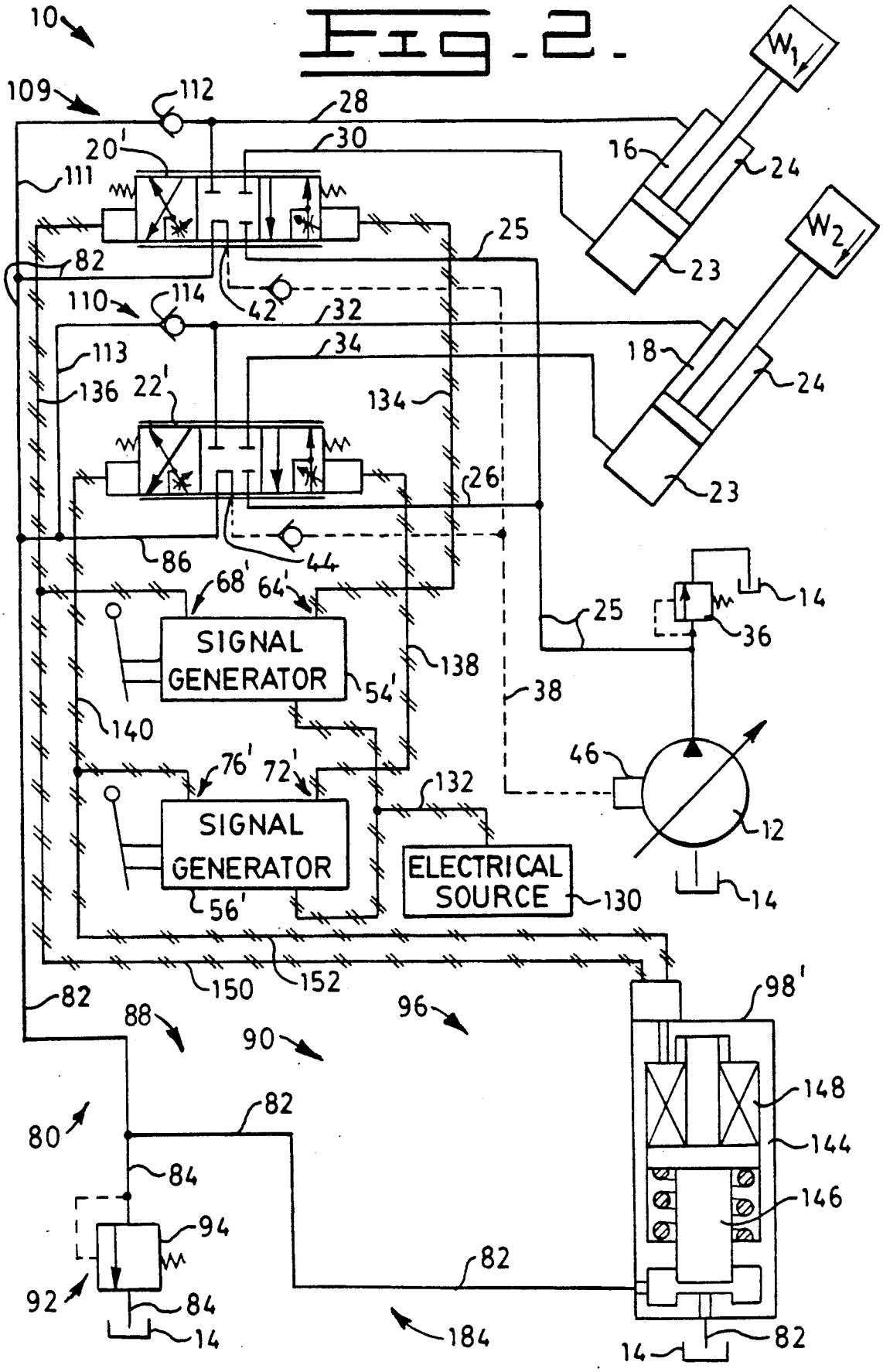
FIG. 2 is a partial schematic and diagrammatic representation of a fluid system incorporating yet another embodiment of the present invention.

Referring now to FIG. 2, another embodiment of the fluid system 10 is disclosed. In this arrangement, like elements will be indicated with like element numbers and similar elements will be indicated with like elements numbers having a prime symbol added thereto. A first and second directional control valves 20',22' of FIG. 2 are infinitely variable three position valves which are actuated in response to receipt thereto of an electrical signal. A first and second signal generators 54',56' are electrical signal generators which receive their source of electrical energy from an electrical source 130 through an electrical line 132.

Each of the first and second directional control valves 20',22' is connected to the pump 12 and to the respective head ends 23 and rod ends 24 of the first and second hydraulic cylinders 16,18 as previously set forth in FIGS. 1 and 1A. Likewise, the exhaust fluid from the first and second directional control valves 20',22' is directed to the reservoir 14 through the exhaust conduits 82,84.

The first electrical signal generator 54' is operative to generate a first control signal 64' which is directed to one end of the first directional control valve 20' by an electrical line 134 and a second control signal 68' is directed to the other end of the first directional control valve 20' through an electrical line 136. Likewise, the second electrical signal generator 56' generates a third control signal 72' and directs it to the first end of the second directional control valve 22' through an electrical line 138, and a fourth control signal 76' is directed to the other end of the second directional control valve 22' by an electrical line 140.

The control means 96 of this embodiment includes a normally-open unloading valve 98' which is operative to interrupt the return flow in the conduit 82 to the reservoir 14 in response to receipt of the second or fourth control signals 68',76'. The normally-open unloading valve 98' includes a housing 144 having a piston 146 slidably disposed therein. The piston 146 is movable to the closed position in response to a coil 148 receiving an electrical signal. The coil 148 is connected to the second control signal 68' by an electrical line 150 and also connected to the fourth control signal 76' by an electrical line 152. The coil 148 is a part of a solenoid which is an electromechanical device well known in the art to produce a force upon receipt of an electrical signal to move an armature. In the subject arrangement a portion of the piston 146 serves as the armature. Upon receipt of the second or fourth electrical control signals 68',76', the piston 146 is moved to the closed position to interrupt the return flow of fluid in the exhaust conduit 82 to the reservoir 14.

From the teaching of FIG. 1A, it should be recognized that a normally-open unloading valve 98' of the subject arrangement could also be normally-closed unloading valve and be operative to the open position in response to the first or third electrical control signals 64',72' without departing from the essence of the invention.

Figure 3:
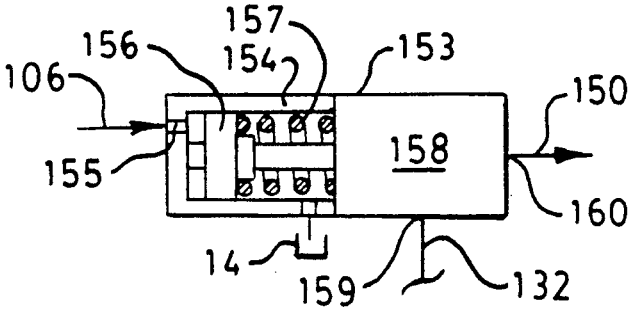
FIG. 3 is a diagrammatic representation of an alternate embodiment of a component for use in the fluid system of FIG. 2.

Referring to FIG. 3, a signal converter 153 is provided. The signal converter 153 may be utilized in a system having both the hydraulic signal generator 54 or 56 and the electrically responsive normally-open unloading valve 98'. The signal generator 153 includes a housing 154 having an inlet port 155 and a piston 156 slidably disposed in the housing 154. The piston 156 is spring biased to a first position in response to a spring 157 and movable toward a second position in response to a hydraulic signal received at the inlet port 155. The housing 154 also includes a rheostat 158 responsive to movement of the piston 156 to regulate an electrical signal received at an inlet connection 159 and to pass the regulated electrical signal to an outlet connection 160.

Figure 4:
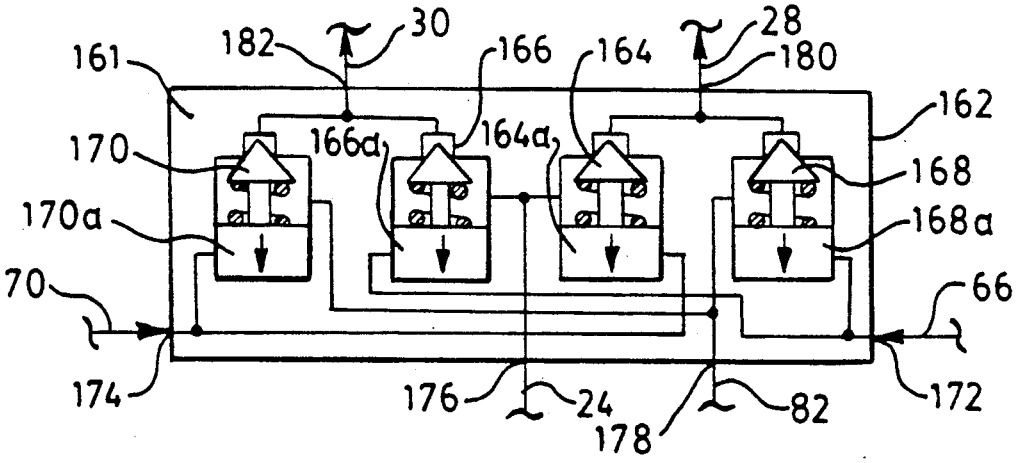
FIG. 4 is a diagrammatic representation of an alternate embodiment of a component that could be utilized in the fluid systems set forth in FIG. 1, FIG. 1A, and FIG. 2.

Referring now to FIG. 4, another embodiment of the first and second directional control valves 20,22,20',22' is set forth. The first and second directional control valves illustrated in FIG. 1 are hydraulically actuated and are of a spool type wherein the first and second directional control valves 20',22' of FIG. 2 are electrically actuated and are likewise of the spool type. The directional control valve illustrated in FIG. 4 is a poppet directional control valve and can be readily substituted for the spool type valves in FIGS. 1, 1A, and 2. The poppet type directional control valve 161 includes a housing 162 having first, second, third, and fourth normally-closed poppet valves 164,166,168,170 disposed therein. Each of the poppet valves 164,166,168,170 are spring biased to the closed position and movable to the open position in response to a control signal being received by respective first, second, third, and fourth controllers **164*a*,166*a*,168*a*,170*a*. The housing 162 also includes first and second signal control connections 172,174, a pump inlet port 176, a fluid exhaust port 178, and first and second cylinder ports 180,182**.

The exhaust manifold means 80, the first and second anti-cavitational valves means 109,110, and the first and second generating means 50,52 make up an exhaust pressurizing control 184 for use in the fluid system 10.

It is recognized that various forms of the fluid system 10 can be used without departing from the essence of the invention. For example, even through double acting hydraulic cylinders 16,18 are illustrated in the drawings, it is recognized that rotary fluid motors could be used without departing from the essence of the invention. Furthermore, if only one hydraulic cylinder is being utilized, then the normally-opened unloading valve 98 of FIG. 1 would not need the second piston 104 or the associated conduit 108. Likewise, if only one hydraulic cylinder is being utilized in the arrangement of FIG. 2, then the electrical line 152 would not be needed. In addition, the directional control valves shown in the various embodiments are of the load responsive type, however, it should be recognized that these directional control valves could be of other conventional types well known by those skilled in the art.

Industrial Applicability

Referring to the embodiment set forth in FIG. 1, upon actuation of the first signal generator 54 by the operator, the first control signal 64 is generated and directed to one end of the directional control valve 20 moving it to its actuated position to direct pressurized fluid from the pump 12 to the head end 23 of the first hydraulic cylinder 16. The pressurized fluid moves the resisting type load $W_1$ upwardly and the fluid exiting from the rod end 24 of the hydraulic cylinder 16 is directed through conduit 28 across the directional valve 20 to the exhaust conduit 82. The return flow in conduit 82 is directed simultaneously to the relief valve 94 and the normally-open unloading valve 98. Since the unloading valve 98 is open, the fluid flow in the conduit 82 passes freely to the reservoir 14.

Upon movement by the operator of the first signal generator 54 to a position to generate the second control signal 68, the directional control valve 20 is moved to its second operative position to direct pressurized fluid through the conduit 28 to the rod end of the first hydraulic cylinder 16. In this operational condition, the load $W_1$ is an aiding type load. The fluid from the head end 23 of the first hydraulic cylinder 16 is directed through conduit 30 across the first directional control valve 20 to the exhaust conduit 82. In this operational condition, since the load $W_1$ is an aiding type load, the fluid flow out of the head end 23 thereof exhausts so quickly, that the quantity of fluid entering the rod end 24 thereof through the conduit 28 from the pump 12 is not sufficient to keep the rod end 24 filled. Consequently, cavitation or a negative pressure condition exists in the rod end 24. In order to offset the cavitation in the rod end 24 of the first hydraulic cylinder 16, the second control signal 68 is simultaneously directed to the first piston 102 of the normally-opened unloading valve 98. Upon receipt of the second control signal 68, the piston 102 of the normally-open unloading valve 98 moves to the closed position which interrupts the flow of fluid in the exhaust conduit 82 to the reservoir 14. Since the return flow through the exhaust conduit 82 is blocked, the fluid flow in the exhaust conduit 82 must pass through the exhaust conduit 84 to the relief valve 94. The pressure in the exhaust conduit 82 builds until the predetermined pressure level of the relief valve 94 is achieved, wherein the fluid flow passes through the exhaust conduit 84 to the reservoir 14. As long as the second control signal 68 is acting on the normally-opened unloading valve 98, the fluid pressure in the exhaust conduit 82 is at the level established by the relief valve 94. The pressurized fluid in exhaust conduit 82 is available through the conduit 111 and one-way check valve 112 to the conduit 28 and subsequently to the rod end 24 of the first hydraulic cylinder 16. Consequently, the return fluid flow from the head end 24 thereof is directed through the conduit 82 and the anti-cavitational valve means 109 to maintain the fluid pressure in the rod end 24 at a level equivalent to the predetermined pressure setting of the relief valve 94. By the addition of the pressurized fluid to the rod end 24 thereof, there is no lag in the response of the system once the load $W_1$ reaches a position wherein further movement is resisted and downpressure is needed. Furthermore, once the load $W_1$ reaches the position of resistance, the stiffness in the first hydraulic cylinder 16 created by the pressurized fluid in the rod end 24 thereof reduces the tendency for the load $W_1$ to rebound in an upward direction. Upon movement by the operator of the first signal generator 54 to a neutral position, the second control signal 68 is interrupted and the directional control valve 20 returns to its neutral inoperative position and the normally-open unloading valve 98 moves to its normally-open position.

Upon movement by the operator of the second signal generator 56 to produce the third control signal 72, the second directional control valve 22 is moved to its first operative position. Pressurized fluid is directed from the pump 12 to the head end 23 of the second hydraulic cylinder 18 to move the second resisting type load $W_2$. The exhaust flow from the rod end 24 thereof is directed through conduit 30 and across the second directional control valve 22 to the exhaust conduit 86 and subsequently to the exhaust conduit 82. This exhausted fluid flow is returned to the reservoir 14 across the normally-open unloading valve 98. Movement by the operator of the second signal generator 56 to the other operative position generates the fourth control signal 76. The fourth control signal 76 is directed to the other end of the second directional control valve 22 moving it to its second operative position wherein fluid flow from the pump 12 is directed through the conduit 32 to the rod end 24 of the second hydraulic cylinder 18 thus moving the aiding type load $W_2$ in a downward direction. The exhaust fluid from the head end 23 thereof is directed through conduit 34 across directional control valve 22 to the exhaust conduit 86 and consequently to the return conduit 82. Since the pressurized fluid is being directed to the rod end 24 of the second hydraulic cylinder 18 and the load $W_2$ is an aiding type load, the exhaust flow from the head end 23 thereof is exhausting at a rate faster than the rate of the fluid flow coming into the rod end 24 thereof. Consequently, cavitation exists in the rod end 24 of the second hydraulic cylinder 18. In order to offset the cavitation in the rod end 24 thereof, the fourth control signal 76 is directed to the second piston 104 of the normally-open unloading valve 98. The fourth control signal 76 acting on the second piston 104 moves the second piston 104 against the first piston 102 to move the first piston 102 to its closed position, thus, blocking fluid flow in the return conduit 82. The fluid flow exhaust conduit 82 is forced to flow through the conduit 84 across the relief valve 94 to the reservoir 14. The pressurized fluid now present in the exhaust conduit 86 is directed through conduit 113 and one-way check valve 114 to the conduit 32 and subsequently to the rod end 24 of the second hydraulic cylinder 18. The pressurized fluid in the rod end 24 thereof effectively eliminates the cavitation that would otherwise exist therein and add stiffness to the second hydraulic cylinder which offsets any lag in the system and/or rebound upon the load $W_2$ reaching a position of resistance. Once the operator moves the second signal generator 56 to its neutral position, the fourth control signal 76 is interrupted and the second directional control valve 22 returns to its inoperative position. Simultaneously, the normally-open unloading valve 98 returns to its normally-open position.

Referring to FIG. 1A, the operation of the system is substantially the same as the operation of the system previously set forth in FIG. 1. However, in this arrangement, the primary difference is that the control means 96 is a normally-closed unloading valve 116. Consequently, upon movement of the first signal generator 54 by the operator to generate the first control signal 64, the first control signal 64 moves the first directional control valve 20 to its first operative position directing pressurized fluid to the head end 23 of the first hydraulic cylinder 16 to raise the resisting type load $W_1$. The return fluid from the rod end 24 thereof is directed through conduit 28 across the first directional control valve 20 to the exhaust conduit 82. The exhaust return flow in exhaust conduit 82 is simultaneously directed to the normally-closed unloading valve 116 and to the relief valve 94. Since the normally-closed unloading valve 116 has the flow in exhaust conduit 82 interrupted, the fluid flow must pass across the relief valve 94. Consequently, a positive pressure is provided in the exhaust conduit 82. This pressurized fluid in the exhaust conduit 82 is not needed during the raising of the resisting type load $W_1$. Therefore, it is desirable to eliminate the pressure in the exhaust conduit 82.

In this arrangement, the first control signal 64 is directed to act on the first piston 120 of the normally-closed unloading valve 116 to move the first piston 120 to an open position allowing free flow of the fluid in the exhaust conduit 82 to the reservoir 14. Upon movement by the operator of the first signal generator 54 to the position to produce the second control signal 68, the first directional valve 20 is moved to its second actuated position wherein the pressurized fluid from the pump 12 is directed to the rod end 24 of the first hydraulic cylinder 16 through the conduit 28 to move the aiding type load $W_1$ downwardly. The return fluid from the head end 23 thereof is directed through conduit 30 across the first directional control 20 to the exhaust conduit 82. The return flow in the exhaust conduit 82 is simultaneously directed to the relief valve 94 and the normally-closed unloading valve 116. Since the unloading valve 116 is normally closed, the fluid flow in the exhaust conduit 82 is interrupted and the fluid flow must flow across the relief valve 94. The pressurized fluid now in the exhaust conduit 82 is directed through the conduit 111 and the one-way check valve 112 to the conduit 28 and subsequently to the rod end 24 of the first hydraulic cylinder 16. The pressurized fluid directed to the rod end 24 thereof not only eliminates any possibility of cavitation existing in the rod end 24 during downward movement of the aiding type load $W_1$, but maintains a pressure in the rod end 24 to a level as determined by the setting of the pressure relief valve 94.

Upon movement by the operator of the second signal generator 54 to the position to generate the third control signal 72, the second directional control valve 22 is moved to its first operative position to connect the pressurized fluid from the pump 12 to the head end 23 of the second hydraulic cylinder 18 to raise the resisting type load $W_2$. The third control signal 72 is simultaneously directed to the normally-closed unloading valve 116 and acts against the second piston 122 to move the second piston 122 against the first piston 120 causing the first piston to move to an open position. This allows free fluid flow through the exhaust conduit 82 to the reservoir 14. Since the pressurized fluid from the pump 12 is raising a resisting type load $W_2$, the exhaust fluid from the rod end 24 thereof is directed through the conduit 32 across the second directional control valve 22 to the conduits 86,82 to freely flow to the reservoir 14.

Upon movement by the operator of the second signal generator to the position to generate the fourth control signal 76, the second directional control valve 22 moves to its second operative position to connect pressurized fluid from the pump 12 to the rod end 24 of the second hydraulic cylinder 18 to move the aiding type load $W_2$ in a downward direction. The exhaust fluid exiting from the head end 23 thereof flows through the conduit 34 across the second directional control valve 22 to the exhaust conduit 86 and exhaust conduit 82 simultaneously to the relief valve 94 and the normally-closed unloading valve 116. Since the unloading valve 116 is normally closed, the fluid flow must pass across the relief valve 94 to the reservoir 14. Consequently, the exhaust conduit 86 is pressurized and the pressurized fluid in conduit 86 is directed through conduit 113 and check valve 114 to the conduit 32 and subsequently to the rod end 24 of the second hydraulic cylinder 18. The pressurized fluid being subjected to the rod end 24 thereof eliminates any possibility of cavitation existing therein.

Referring to the operation of FIG. 2, the operation therein is effectively the same as the operation of the system set forth in FIG. 1, with the exception that the first and second directional control valves 20',22' of FIG. 2 are controlled by the first, second, third, and fourth electric control signals which are being generated by first and second electrical signal generators 54'56', and the normally-open unloading valve 98' is movable to the closed position in response to receipt of an electrical control signal.

Consequently, when the load $W_1$ of the first hydraulic cylinder 16 is being lowered responsive to the generation of the second control signal 68', the second control signal 68' is likewise directed to the normally-open unloading valve 98'. The second control signal 68' acting on the coil 148 moves the normally-open unloading valve 98' to its closed position to interrupt the flow of fluid in the exhaust conduit 82 to the reservoir 14. With the normally-open unloading valve 98' closed, the fluid flow in exhaust conduit 82 must pass across the relief valve 94 which maintains a positive pressure in the exhaust conduit 82. As described and set forth above in the fluid system 10 of FIG. 1, the pressurized fluid in the exhaust conduit 82 is directed through the conduit 111 and the one-way check 112 to the rod end 24 of the first hydraulic cylinder 16 to eliminate any possibility of cavitation therein due to the lowering of the aiding type load $W_1$.

Likewise, when the load $W_2$ of the second hydraulic cylinder 18 is being lowered in response to the operator generating the fourth control signal 76', the fourth control signal 76' acts on the coil 148 of the normally-open unloading valve 98' to interrupt the flow of fluid in the exhaust conduit 82 to the reservoir 14. Consequently, the flow must pass across the relief valve 94 which maintains the positive pressure in the exhaust conduits 82,86. The pressurized fluid in the exhaust conduit 86 is directed through the conduit 113 and one-way check valve 114 to the rod end 24 of the second hydraulic cylinder 18 to effectively eliminate any possibilities of cavitation therein.

It should be recognized from a review of FIGS. 1, 1A and 2 that when raising (resisting load) the first load $W_1$ and lowering (aiding load) the second load $W_2$ the controls means 96 of the exhaust manifold means 80 functions to pressurize the exhaust conduit 82. Pressurizing the exhaust conduit 82 ensures the existence of a positive pressure through the second anti-cavitational means 110 to the rod end 24 of the second hydraulic cylinder 18 when lowering the aiding type load $W_2$. Simultaneously, the positive pressure in the exhaust conduit 82 is available through the first anti-cavitational valve means 109 to the rod end 24 of the first hydraulic cylinder 16 which is raising the resisting type load $W_1$. The benefit of eliminating cavitation in the rod end 24 of the second hydraulic cylinder 18 far exceeds the disadvantage of the added pressure being subjected to the rod end 24 of the first hydraulic cylinder 16. It should be recognized that the added pressure in the rod end 24 of the first hydraulic cylinder 16 merely adds to the load $W_1$ and the pump 12 must provide extra energy to overcome the extra added load.

In the arrangement of FIG. 3, the signal convertor 153 can be installed in a system so that hydraulic signal generators 54,56 may be used in combination with electrically actuated unloading valves 98'. The inlet port 155 of the signal converter 153 is connected to the hydraulically generated second control signal 68 through conduit 106 and the pressurized fluid therein acts against the piston 156 thereof to convert the hydraulic signal 106 to an electrical signal. The source of electrical energy 130 is connected to the inlet connection 159 of the the rheostat 158 by the conduit 132 and the regulated electrical signal is transmitted to the outlet connection 160 to which electrical line 150 is connected. Consequently, in the embodiment set forth in FIG. 1, the hydraulically generated control signals can be converted into electrical control signals by use of two signal converters to control the operation of an electrically responsive unloading valve 98'.

With reference to FIG. 4, the poppet type directional control valve 161 can be readily substituted for the spool type directional control valves 20,22,20',22' described above. To better describe the ease of substituting this arrangement for the above-noted spool type directional control valves, FIG. 1 will be used as an example. The poppet type directional control valve 161 of FIG. 4 will be substituted for the spool type directional control valve 20 of FIG. 1. The conduit 25 from the pump 12 is in communication with the first and second poppet type valves 164,166 through the pump inlet port 176 and the exhaust conduit 82 is in communication with the third and fourth poppet type valves 168,170 through the fluid exhaust port 178. The rod end 24 of the first hydraulic cylinder 16 is in communication with the first and third poppet type valves 164,168 through the first cylinder port 180. The conduit 30 connects the head end 23 of the first hydraulic cylinder 16 with the second and fourth poppet type valves 166,170 through the cylinder port 182. Likewise, the first control signal 64 is connected through conduit 66 and the first signal control connection 172 to the second and third controllers **166*a*,168*a*. The second control signal 70 is connected by the conduit 70 and the second signal control connection 174 to the first and fourth controllers 164*a*,170*a*. Consequently, upon receipt by the second and third controllers 166*a*,168*a* of the first control signal 66, the second and third poppet type valves 166,168 are opened allowing the flow from the pump 12 to be directed to the head end 23 of the first cylinder type fluid motor 16 and the exhaust flow from the rod end 24 is directed to the third poppet type valve 68 and thereacross to the exhaust conduit 82**.

Upon receipt by the first and fourth controllers **164*a*,170*a* of the second control signal 70, the first and fourth poppet type valves 164,170 are opened allowing the pressurized fluid from the pump 12 to be directed to the rod end 24 of the first hydraulic cylinder 16 and the return flow therefrom is directed to the fourth poppet type valve 170 and thereacross to the exhaust conduit 82. When the second and third poppet type valves 166,168 are being opened by the first control signal 66 being directed to the second and third controllers 166*a*,168*a*, the first and fourth poppet type valves remain closed due to the absence of a control signal being directed to the first and fourth controllers 164*a*,170*a*. Likewise, in a similar manner, when the first and fourth poppet type valves 164,170 are opened, the second and third poppet type valves 166,168 remain closed. It should be recognized without departing from the essence of the invention that if a poppet type directional control valve is desired for use in the arrangement set forth in FIG. 2**, the poppets are electrically controlled as opposed to being hydraulically controlled.

The exhaust pressurizing control 184 of the fluid system 10 as set forth in the above described embodiments provides an arrangement that eliminates cavitation in the first and second hydraulic cylinders 16,18 during lowering of aiding type loads $W_1$, $W_2$. The elimination of cavitation in the hydraulic cylinders 16,18 and the adding of a positive pressure therein provides better stiffness in the hydraulic cylinders during operation. This stiffness eliminates both time lag in the system and the possibility of load rebound once the load $W_1/W_2$ reaches the position of resistance.

Other aspects, objects, and advantages of this invention can be obtained from a study of the drawings, the disclosure, and the appended claims.

I claim:

1. An exhaust pressurizing control adapted for use in a fluid system having a fluid motor subjected alternately to a unidirectional positive type load and a unidirectional negative type load, the fluid system having a pump, a reservoir, and a directional control valve operable to selectively interconnect the fluid motor with the pump and the reservoir, the exhaust pressurizing control, comprising:

exhaust manifold means interposed between the directional control valve and the reservoir;

anti-cavitational valve means interposed between the exhaust manifold means and the fluid motor;

means for generating a first control signal to control through the directional control valve the movement of the unidirectional positive type load and for generating a second control signal to control through the directional control valve the movement of the unidirectional negative type load; and said exhaust manifold means having a selector means for pressurizing the exhaust manifold means during control of the unidirectional negative type load and to depressurize the exhaust manifold means during control of the unidirectional positive type load, the selector means being responsive to one of the first and second control signals.

2. The exhaust pressurizing control as set forth in claim 1, wherein the selector means includes pressure limiting and unloading means.

3. The exhaust pressurizing control as set forth in claim 2, wherein the pressure limiting and unloading means includes control means for interrupting communication of fluid flow between the exhaust manifold means and the reservoir during control of the unidirectional negative type load.

4. The exhaust pressurizing control as set forth in claim 3, wherein the control means opens communication of fluid flow between the exhaust manifold means and the reservoir during control of the unidirectional positive type load.

5. The exhaust pressurizing control as set forth in claim 4, wherein the control means is responsive to one of the first and second control signals.

6. The exhaust pressurizing control as set forth in claim 5, wherein the pressure limiting and unloading means includes a pressure limiting means.

7. The exhaust pressurizing control as set forth in claim 6, wherein the pressure limiting means is a pressure relief valve.

8. The exhaust pressurizing control as set forth in claim 6, wherein the control means includes a normally-open unloading valve.

9. The exhaust pressurizing control as set forth in claim 8, wherein the normally-open unloading valve is spring biased to the open position and movable to the closed position in response to the second control signal.

10. The exhaust pressurizing control as set forth in claim 9, wherein the fluid motor is a hydraulic cylinder and the normally-open unloading valve includes a housing having a piston slidably disposed therein and operative in response to receipt of the second control signal to selectively interrupt communication of fluid flow between the exhaust manifold means and the reservoir.

11. The exhaust pressurizing control as set forth in claim 6, wherein the fluid system has a second fluid motor subjected alternately to a second unidirectional positive type load and a second unidirectional negative type load, and a second directional control valve operable to selectively interconnect the second fluid motor with the pump and the reservoir, and wherein said exhaust manifold means is interposed between the second directional control valve and the reservoir, second anti-cavitational valve means is interposed between the exhaust manifold means and the second fluid motor, second means for generating a third control signal to control through the second directional control valve the displacement of the second unidirectional positive type load and for generating a fourth control signal to control through the second directional control valve the displacement of the second unidirectional negative type load, said control means is responsive to one of the third and fourth control signals to interrupt communication of fluid flow between the exhaust manifold means and the reservoir during control of the second unidirectional negative type load.

12. The exhaust pressurizing control as set forth in claim 11, wherein the control means opens communication of fluid flow between the exhaust manifold means and the reservoir during control of the second unidirectional positive type load.

13. The exhaust pressurizing control as set forth in claim 12, wherein the control means is responsive to the fourth control signal.

14. The exhaust pressurizing control as set forth in claim 13, wherein the control means includes a normally-open unloading valve.

15. The exhaust pressurizing control as set forth in claim 14, wherein the normally-open unloading valve is spring biased to the open position and movable to the closed position in response to the second or fourth control signals.

16. The exhaust pressurizing control as set forth in claim 15, wherein the first and second fluid motors are hydraulic cylinders and the normally-open unloading valve includes a housing having a first piston slidably disposed therein and operative in response to receipt of the second control signal to selectively interrupt communication of fluid flow between the exhaust manifold means and the reservoir, and a second piston slidably disposed in the housing adjacent the first piston and operative in response to receipt of the fourth control signal to move the first piston to interrupt communication of fluid flow between the exhaust manifold means and the reservoir.

17. The exhaust pressurizing control as set forth in claim 16, wherein the first and second generating means are hydraulic signal generators connected to a source of pressurized fluid and the first and second directional control valves are actuated by hydraulic control signals.

18. The exhaust pressurizing control as set forth in claim 16, wherein the first and second generating means are electrical signal generators connected to a source of electrical energy and the first and second directional control valves are actuated by electrical control signals.

19. The exhaust pressurizing control as set forth in claim 16, wherein the first and second directional control valves are spool type valves.

20. The exhaust pressurizing control as set forth in claim 16, wherein the first and second directional control valves are poppet type valves.

21. The exhaust pressurizing control as set forth in claim 6, wherein the control means includes a normally-closed unloading valve.

22. The exhaust pressurizing control as set forth in claim 21, wherein the normally-closed unloading valve is spring biased to the closed position and movable to the open position in response to the first control signal.

23. The exhaust pressurizing control as set forth in claim 22, wherein the normally-closed unloading valve includes a housing having a piston slidably disposed therein and operative in response to receipt of the first control signal to selectively open communication of fluid flow between the exhaust manifold means and the reservoir.

24. The exhaust pressurizing control as set forth in claim 23, wherein the fluid system has a second cylinder type fluid motor subjected alternately second unidirectional positive type load and a second unidirectional negative type load, and a second directional control valve operable to selectively interconnect the second fluid motor with the pump and the reservoir, and wherein said exhaust manifold means is interposed between the second directional control valve and the reservoir, second anti-cavitational valve means is interposed between the exhaust manifold means and the second fluid motor, second means for generating a third control signal to control through the second directional control valve the displacement of the second unidirectional positive type load and for generating a fourth control signal to control through the second directional control valve the displacement of the second unidirectional negative type load; said control means is responsive to one of the third and fourth control signals to open communication of fluid flow between the exhaust manifold means and the reservoir during control of the second unidirectional positive type load.

25. The, exhaust pressurizing control as set forth in claim 24, wherein the control means interrupts communication of fluid flow between the exhaust manifold means and the reservoir during control of the second unidirectional negative type load.

26. The exhaust pressurizing control as set forth in claim 25, wherein a second piston is slidably disposed in the housing adjacent the first piston and operative in response to receipt of the third control signal to move the first piston to open communication of fluid flow between the exhaust manifold means and the reservoir.

27. The exhaust pressurizing control as set forth in claim 26, wherein the first and second fluids motors are hydraulic cylinders.

* * * * *

UNITED STATES PATENT AND TRADEMARK OFFICE

CERTIFICATE OF CORRECTION

PATENT NO. : 5,044,256

DATED : September 3, 1991

INVENTOR(S) : Tadeusz Budzich

It is certified that error appears in the above-identified patent and that said Letters Patent is hereby corrected as shown below:

Claim 24, column 14, line 23, after "alternately", please insert --to a--.

Claim 25, column 14, line 43, after "The", please delete ",".

Signed and Sealed this

Twelfth Day of January, 1993

*Attest:*

DOUGLAS B. COMER

*Attesting Officer*

*Acting Commissioner of Patents and Trademarks*